United States Patent [19]

Watanabe

[11] Patent Number: 5,064,996

[45] Date of Patent: Nov. 12, 1991

[54] ELECTRIC FURNACE

[75] Inventor: Toru Watanabe, Tokyo, Japan

[73] Assignee: Sakaguchi Dennetsu Kabushiki Kaisha, Tokyo, Japan

[21] Appl. No.: 559,365

[22] Filed: Jul. 30, 1990

[51] Int. Cl.[5] ..... F27B 5/14; F27D 11/00

[52] U.S. Cl. ..... 219/390

[58] Field of Search ..... 219/390, 389, 536, 537, 219/542, 546, 552, 553; 373/119, 127, 130; 392/432, 433, 434

[56] References Cited

U.S. PATENT DOCUMENTS

| | | | |
|---|---|---|---|
| 4,207,672 | 6/1980 | Wohlert | 219/542 |
| 4,575,619 | 3/1986 | Porzky | 219/542 |
| 4,596,922 | 6/1986 | Erickson | 219/390 |

*Primary Examiner*—Teresa J. Walberg
*Assistant Examiner*—Tuan Vinh To
*Attorney, Agent, or Firm*—Nilles & Nilles

[57] ABSTRACT

An electric furnace wherein a belt-like heating member in the shape of zigzag or wave is wound helically on the inner surface of a cylindrical heat insulating member and portions of the inner surface of the belt-like heating member are covered with portions of the heat insulating member, so that the heating member is held securely by the heat insulating member.

5 Claims, 1 Drawing Sheet

ELECTRIC FURNACE

BACKGROUND OF THE INVENTION

1. Field of the Invention

This invention relates to an electric furnace, and more particularly to an improvement of an electric furnace.

2. Description of the Prior Art

In the electric furnace, generally, entire inner surface of the electric furnace is covered with a heating member and between the furnace cover and the outer surface of the heating member a heat insulating material is inserted in order that the temperature of the heating member will be as close as possible to the inside temperature of the furnace so that the uniform heating property can be increased.

However, such an electric furnace is hardly used because of problems, such as change in configuration due to the heat expansion and increase of cost due to the setting of electric resistors or current paths according to the electric capacity.

In the conventional electric furnace, therefore, a serpentine heating wire or heating coil is wound around the inner surface of the electric furnace and supported by the heat insulating member, electric current is supplied to the heating wire causing it to radiate. In cases where the electric furnace is used for heating it is very important to maintain high temperature, uniform heating and elevating and lowering temperature properties. If the heating wire is of large diameter it is formed helically as it is.

In the electric furnace using the serpentine heating wire it is necessary to make the heating wire with a fine pitch in order to obtain a sufficient effective area facing the center of the furnace, and thus the number of manufacturing steps becomes large and the wire configuration is changed easily by thermal expansion. Accordingly, the heating wire must be adhered to the inner surface of the heat insulating material by using a heat insulating coating material. However, as the heating wire is changed in shape due to heat expansion and because of the fall off of the coating material at the high temperature atmosphere the wire is subject to being easily broken.

In the electric furnace using the heating wire of large diameter, if the effective area facing the center of the furnace is large the percentage of the cost of materials in the electric furnace becomes very large near to 50% and the heat capacity of the heating wire itself is large, so that it is difficult to obtain a good elevating and lowering temperature property. Further, a sag is generated easily in the heating wire at a high temperature atmosphere, so that the heating wire is liable to short or break down.

SUMMARY OF THE INVENTION

An object of the present invention is to obviate the above defect of the conventional electric furnace.

The above object can be attained by an electric furnace comprising a cylindrical heat insulating member, and a belt-shaped and waved heating member wound helically on the inner surface of the heat insulating member so as to face the center of furnace.

The other objects and features of the present invention will become apparent from the following description taken in conjunction with the accompanying drawings.

DESCRIPTION OF THE PREFERRED EMBODIMENT

Now, one embodiment of this invention will be described by referring to FIGS. 1 through 4.

An electric furnace of the present invention having an inner diameter of 300 mm and a length of 2 m, for example, uses belt-shaped and waved heating strip 1 1 mm thick and 10 mm wide. The belt-shaped and waved heating strip 1 is wound helically on the inner surface of a cylindrical heat insulating member 2 with the flat face of the heating strip faced toward the open center of the furnace.

The electric furnace of the present invention is manufactured, for example, by winding the belt-shaped and waved heating strip 1 helically around a jig of columnar shape, surrounding the outer surface of the heating strip 1 with the heat insulating member 2 of softened clay ceramics with or without a binder impregnated therein, and solidfying the heat insulating member 2 to hold the heating strip 1.

Figure 1:
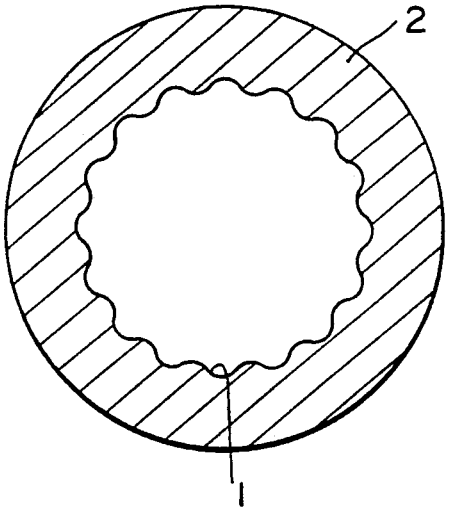
FIG. 1 is a sectional side view of an electric furnace of the present invention.
Figure 2:
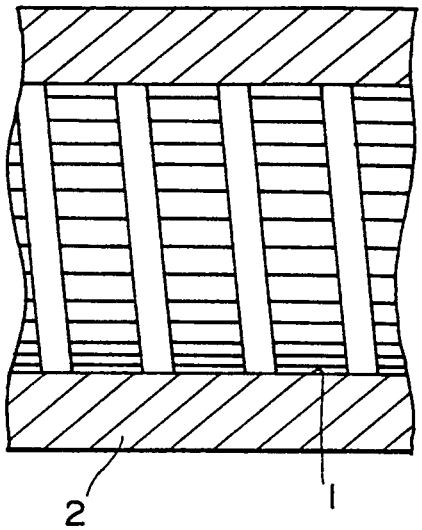
FIG. 2 is a sectional front view of a part of the electric furnace.
Figure 3:
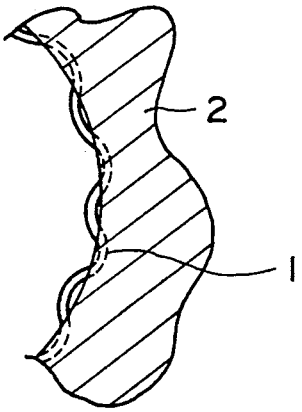
FIGS. 3 and 4 are partial enlarged views of the electric furnace shown in FIGS. 1 and 2, respectively.
Figure 4:
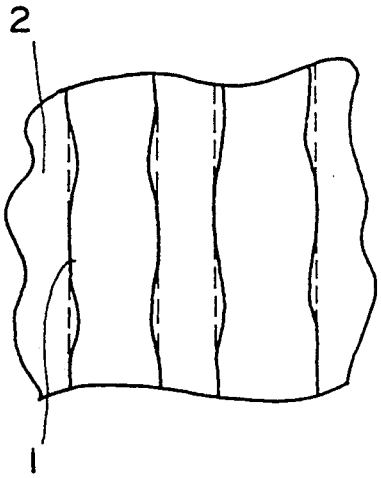

It is preferable that boundary portions of the inner surface of the waved strip heating 1 are covered with the heat insulating member 2, as shown in FIGS. 3 and 4, so as to beheld securely by the heat insulating member 2.

According to the electric furnace of the present invention, the effective surface area of the heating strip facing the center of the furnace can be made large, and the cost of materials for forming the electric furnace can be reduced by 1/7 compared with an electric furnace used a heating wire of large diameter having the same effective surface area. Further, because the heating strip is small in heating capacity a good elevating and lowering heating property can easily be obtained and because the heating plate is light in weight the sag thereof at a high temperature atmosphere hardly occurs. Furthermore, the heating strip can be supported firmly by the heat insulating member by using the wave portions thereof, so that the configuration of the heating strip can be prevented from being varied.

What is claimed is:

1. An electric furnace comprising: a cylindrical heat insulating member having an inner peripheral surface and a center; and a belt-shaped heating member having radially inward and outward directed wave portions wound helically around said inner peripheral surface of said heat insulating member so as to face said center of the furnace.

2. The electric furnace according to claim 1, wherein said belt-shaped and waved heating member has inner facing boundary portions, and said heat insulting member has overlaped portions on said inner facing boundary portions to hold said belt-shaped and waved heating member on said inner surface.

3. An electric furnace comprising: a cylindrical heat insulating member having an axis, a center and a radially inner surface in spaced facing relation to said center; and a helix heating member, said helix heating member comprising a continuous helically wound strip mounted on said inner surface and having a unitary, flat face elongated axially and circumferentially that is in spaced facing relation to said center of the furnace.

4. The electric furnace according to claim 3 wherein said helically wound strip is serpentine in shape having radially inward and outward directed wave portions.

5. The electric furnace according to claim 4 wherein portions of said heat insulating member cover parts of said radially outward directed wave portions to securely hold said heating member.

* * * * *